US008439082B2

(12) United States Patent
O'Connell

(10) Patent No.: US 8,439,082 B2
(45) Date of Patent: May 14, 2013

(54) RETENTION MECHANISM FOR SUBTERRANEAN SEALS EXPERIENCING DIFFERENTIAL PRESSURE

(75) Inventor: Maria M. O'Connell, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 361 days.

(21) Appl. No.: 12/823,906

(22) Filed: Jun. 25, 2010

(65) Prior Publication Data

US 2011/0315373 A1 Dec. 29, 2011

(51) Int. Cl.
*F16L 55/10* (2006.01)

(52) U.S. Cl.
USPC ..... 138/89; 138/97; 405/154.1; 405/184.1

(58) Field of Classification Search ..... 138/89, 138/97; 405/154.1, 184.1
See application file for complete search history.

(56) References Cited

U.S. PATENT DOCUMENTS

| | | | | |
|---|---|---|---|---|
| 1,773,941 | A * | 8/1930 | Boynton | 166/193 |
| 4,463,597 | A * | 8/1984 | Pierce et al. | 73/40.5 R |
| 5,944,057 | A * | 8/1999 | Pierce | 138/89 |
| 6,434,825 | B1 * | 8/2002 | De Almeida | 29/890.12 |
| 6,678,954 | B2 * | 1/2004 | De Almeida | 29/890.124 |
| 6,840,282 | B2 * | 1/2005 | De Almeida | 138/94 |
| 7,422,071 | B2 | 9/2008 | Wilkie et al. | |
| 7,441,596 | B2 | 10/2008 | Wood et al. | |
| 7,552,768 | B2 | 6/2009 | O'Brien | |
| 7,597,152 | B2 | 10/2009 | Wood et al. | |
| 7,681,653 | B2 | 3/2010 | Korte et al. | |
| 7,730,940 | B2 | 6/2010 | Knippa et al. | |
| 8,061,388 | B1 * | 11/2011 | O'Brien et al. | 138/89 |
| 2009/0178800 | A1 | 7/2009 | Korte et al. | |
| 2009/0229816 | A1 | 9/2009 | Lemme et al. | |
| 2010/0038074 | A1 | 2/2010 | Patel | |
| 2010/0116496 | A1 | 5/2010 | Allen et al. | |

* cited by examiner

*Primary Examiner* — Patrick F Brinson
(74) *Attorney, Agent, or Firm* — Steve Rosenblatt

(57) ABSTRACT

A mandrel is formed with a projection, depression or a surface irregularity to retain the seal material sealing a passage in the mandrel or an annular space around it against differential pressure. The material can be a shape memory or swelling material.

17 Claims, 2 Drawing Sheets

RETENTION MECHANISM FOR SUBTERRANEAN SEALS EXPERIENCING DIFFERENTIAL PRESSURE

FIELD OF THE INVENTION

The field of this invention is subterranean plugs or annular seals that experience pressure differential and more particularly mandrel adaptations designed to retain a material such as a shape memory or swelling material in position against such pressure differentials through mechanical retention.

BACKGROUND OF THE INVENTION

Swelling members have been secured to mandrels in a variety of way. One way is to mount the swelling member on a longitudinally split base and secure the base to the mandrel by closing the split base around the mandrel and inserting a long tapered pin. The swelling material itself is secured to the base with adhesives or other chemical bonding techniques. Illustrative of this design is U.S. Pat. No. 7,730,940.

Another technique is to use rigid rings secured to the mandrel on either end of the sealing element to hold it in position as shown in US Publications 2010/0116496 and 2009/0229816. Yet another way is to shrink fit or create tension in the element adjacent the mandrel in an effort to hold it in position and prevent leak paths along the mandrel and element interface. These concepts are illustrated in U.S. Pat. Nos. 7,441,596 and 7,681,653.

Other designs couple end retention with booster devices to enhance the radial seal force applied beyond the swelling such as by sliding a wedge under the swelling element from at least one end. An example of this design is U.S. Pat. No. 7,552,768. Flexible stacks of notched rings have been disposed at opposed ends of a swelling element with a through bolt extending through the element to pull the end ring stacks toward each other. This is shown in US Publication 2010/0038074. Sometimes the swelling material is located in an inflatable to assist the inflatable in holding a seal as shown in U.S. Pat. No. 7,597,152. Other multi-layered designs of swelling sealing systems are shown in U.S. Pat. No. 7,422,071 and US Publication 2009/0178800.

This design uses a single or series of undercut profiles, slots or retentive groove in the mandrel ID or OD depending on where the material is to be retained. The undercut profile allows for greater mechanical retention of the plug material resisting displacement while experiencing a pressure differential.

The present invention addresses the issue of annular seal or tubular plug retention against pressure differentials in a simplified manner using features of the mandrel or the surrounding tubular and positioning the material adjacent to the mandrel surface formation which can be in the form of a projection or depression or a combination so that the material is better retained against pressure differentials when sealing at a subterranean location. The materials can be shape memory materials or swelling materials. These and other aspects of the present invention will be more readily understood by those skilled in the art from a review of the description of the preferred embodiment and the associated drawings while understanding that the full scope of the invention is to be found in the appended claims.

SUMMARY OF THE INVENTION

A mandrel is formed with a projection, depression or a surface irregularity to retain the seal material sealing a passage in the mandrel or an annular space around it against differential pressure. The material can be a shape memory or swelling material.

DETAILED DESCRIPTION OF THE PREFERRED EMBODIMENT

Figure 1:
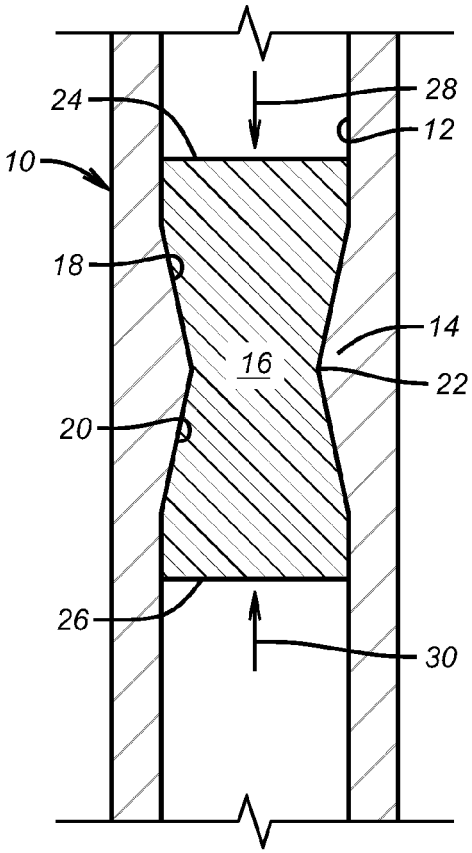
FIG. 1 is a section view of a plug located opposite an internal projection on the mandrel for fixation against pressure differential in opposed directions.

FIG. 1 shows a tubular 10 having an inside diameter 12 in which there is an internal projection 14 that is straddled by a plug 16. The projection 14 has sloping surfaces 18 and 20 that come to a point 22. The plug 16 has an upper end 24 and a lower end 26 that straddle the surfaces 18 and 20 and the point 22 where they meet. The surface 18 helps resist net forces in the direction of arrow 28 and the surface 20 resists forces in the direction of arrow 30.

The plug 16 can be a shape memory polymer that tends to get softer when swelling to a larger dimension and needs fixation assistance that the projection 14 can provide. Other materials that swell can also be used. Other alternatives are swelling rubber or foams or retained mineral clays such as bentonite. While two surfaces 18 and 20 that intersect have been illustrated, either surface can be omitted so that fixation boost occurs in a single preferred direction rather than opposed directions. While surfaces 18 and 20 are shown flat they can be rounded or irregular and can also feature a surface roughness to aid retention of the plug 16.

Figure 3:
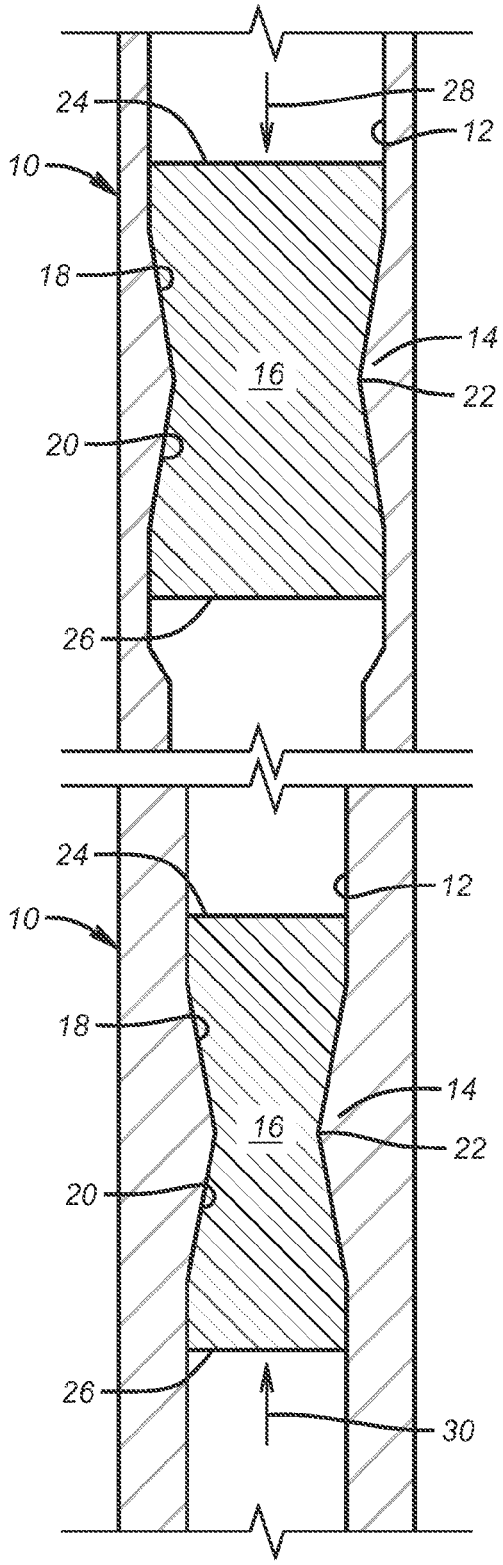
FIG. 3 is an alternative embodiment to FIG. 1 showing stacking plugs.

Instead of the projection 14 the inside wall 12 can be surface roughened to enhance the grip of the plug 16 on the inside diameter or wall 12. Alternatively, the projection 14 can be flipped so it is a recess while still being subject to the alternatives described above when it is in the form of a recess. Depending on the length of the plug 16 and the surfaces 18 and 20 more than one protrusion 14 or its described variations can underlie a single plug. Alternatively, the single plug 16 that is illustrated can be a stack of plugs to seal the interior of the tubular 10 as shown in FIG. 3.

Figure 2:
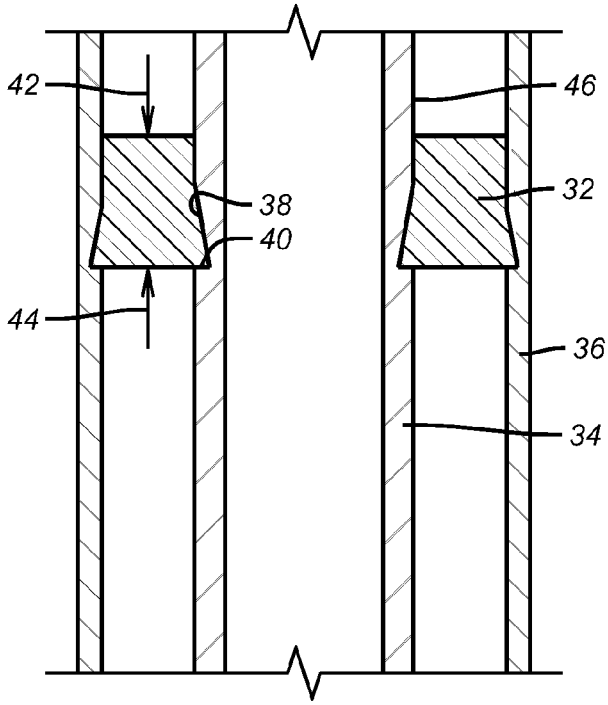
FIG. 2 shows an annularly shaped sealing element to seal an annular space where the mandrel has a depression to assist in fixation against pressure differential.

FIG. 2 illustrates an annular seal 32 on a mandrel 34 and inside of a tubular or casing 36. The mandrel 34 has a recess 38 that is triangularly shaped with flat side 40 that is disposed preferably substantially perpendicular to the axis of the tubular 10 toward the lower end. In this configuration the seal 32 can withstand differentials in the direction of arrows 42 or 44 but preferentially in the direction of arrow 42 because of the location of flat side 40. While a triangularly shaped recess 38 is shown, those skilled in the art will appreciate that recesses of other shapes can be used. Alternatively or additionally the outer surface 46 can be roughened to strengthen the grip on seal 32 against differential pressure. A projection such as described in FIG. 1 can be used in the FIG. 2 design instead or in addition to the recess 38. The single recess 38 can be multiple recesses arranged in minor image triangles so that their flat sides are opposed to better resist differentials in directions 42 and 44. Additionally, a series of similarly oriented recesses can be placed in succession under the seal 32.

All variants discuss for FIG. 1 are intended to be applicable to the FIG. 2 design and vice versa. Apart from the illustrated triangular recess other more complicated shapes such as a T-shaped recess are contemplated.

Those skilled in the art will appreciate that the various embodiments are simple voids or projections or surface textures designed to enhance grip against pressure differential in an environment where a tubular is plugged or an annular space around a tubular is to be sealed. Different shape configurations are employed with an eye toward enhancing the security of the grip against a differential pressure. While the surfaces can be optionally adhesive coated or the plug itself can be placed in position with an exterior adhesive coat, the use of adhesives is totally optional. Mechanical fasteners are not required. The shape can be machined or otherwise formed to the inside or outside of the mandrel, depending on the configuration used.

In another alternative the seal 32 can be used as shown in FIG. 1 as well as a plug 16 shown in FIG. 1. The plug 16 can be installed in position before the tubular 10 is run into the well or it can be inserted later with the tubular 10 already located at the subterranean location.

The above description is illustrative of the preferred embodiment and many modifications may be made by those skilled in the art without departing from the invention whose scope is to be determined from the literal and equivalent scope of the claims below.

I claim:

1. A subterranean plug or annular seal mounted within or outside a tubular, comprising:

a body having an inner surface defining a passage therethrough and an outer surface;

at least one plug or seal mounted to at least one of said inner and outer surfaces;

at least one seal or plug retention feature fixedly mounted on said body and in contact with said seal or plug;

said seal or plug retention feature comprises adjacent surfaces in intersecting planes that put a compressive force on said plug or seal to retain said plug or seal in position as a barrier inside or outside said body in response to differential pressure in either of opposed directions acting on said plug or seal.

2. A subterranean plug or annular seal mounted within or outside a tubular, comprising:

a body having an inner surface defining a passage therethrough and an outer surface;

at least one plug or seal mounted to at least one of said inner and outer surfaces;

at least one seal or plug retention feature fixedly mounted on said body and in contact with said seal or plug;

said seal or plug retention feature comprises adjacent surfaces in intersecting planes that put a compressive force on said plug or seal to retain said plug or seal in position as a barrier inside or outside said body in response to differential pressure in either of opposed directions acting on said plug or seal;

said seal or plug comprises a shape memory or swelling material.

3. The plug or seal of claim 1, wherein:

said retention feature comprises surface roughness.

4. The plug or seal of claim 1, wherein:

said retention feature comprises at least one projection.

5. The plug or seal of claim 1, wherein:

said retention feature comprises at least one recess.

6. The plug or seal of claim 1, wherein:

said at least one seal or plug comprises a plurality of stacked seals or plugs.

7. A subterranean plug or annular seal mounted within or outside a tubular, comprising:

a body having an inner surface defining a passage therethrough and an outer surface;

at least one plug or seal mounted to at least one of said inner and outer surfaces;

at least one seal or plug retention feature fixedly mounted on said body and in contact with said seal or plug;

said seal or plug retention feature comprises adjacent surfaces in intersecting planes that put a compressive force on said plug or seal to retain said plug or seal in position as a barrier inside or outside said body in response to differential pressure in either of opposed directions acting on said plug or seal;

said retention feature comprises at least one projection;

said adjacent surfaces are sloping.

8. The plug or seal of claim 4, wherein:

said projection has curved surfaces.

9. The plug or seal of claim 4, wherein:

said projection comprises a single sloping surface that puts a compressive force on said plug or seal in response to differential pressure in one direction acting on said plug or seal.

10. A subterranean plug or annular seal mounted within or outside a tubular, comprising:

a body having an inner surface defining a passage therethrough and an outer surface;

at least one plug or seal mounted to at least one of said inner and outer surfaces;

at least one seal or plug retention feature fixedly mounted on said body and in contact with said seal or plug;

said seal or plug retention feature comprises adjacent surfaces in intersecting planes that put a compressive force on said plug or seal to retain said plug or seal in position as a barrier inside or outside said body in response to differential pressure in either of opposed directions acting on said plug or seal;

said retention feature comprises at least one recess;

said recess has at least one end surface disposed substantially perpendicular to an axis of said body and said seal or plug extends into said recess.

11. The plug or seal of claim 10, wherein:

said at least one end surface comprises a pair of opposed end surfaces to resist pressure differentials in opposed directions.

12. The plug or seal of claim 10, wherein:

said recess has a triangular, rectangular or T-shape in a wall of said body that defines said inner and outer surfaces.

13. The plug or seal of claim 2, wherein:

said seal or plug comprises a shape memory polymer.

14. The plug or seal of claim 1, wherein:

said at least one plug or seal comprises a stacked plurality of plugs or seals.

15. A subterranean plug or annular seal mounted within or outside a tubular, comprising:

a body having an inner surface defining a passage therethrough and an outer surface;

at least one plug or seal mounted to at least one of said inner and outer surfaces;

at least one seal or plug retention feature on said body and in contact with said seal or plug;

said at least one plug or seal comprises a stacked plurality of plugs or seals;

said at least one retention feature comprises a plurality of retention features with one feature associated with each said plug or seal and disposed to resist movement of said plug or seal responsive to pressure differentials from at least one direction.

16. The plug or seal of claim 4, wherein:

said retention feature comprises surface roughness.

17. The plug or seal of claim 5, wherein:

said retention feature comprises surface roughness.

* * * * *